US006110877A

United States Patent [19]

Roberts

[11] Patent Number: 6,110,877

[45] **Date of Patent: *Aug. 29, 2000**

[54] NON-HALOGENATED EXTREME PRESSURE, ANTIWEAR LUBRICANT ADDITIVE

[76] Inventor: John W. Roberts, 7711 Falstaff Rd., McLean, Va. 22102

[ * ] Notice: This patent issued on a continued prosecution application filed under 37 CFR 1.53(d), and is subject to the twenty year patent term provisions of 35 U.S.C. 154(a)(2).

[21] Appl. No.: 09/031,798

[22] Filed: Feb. 27, 1998

Related U.S. Application Data

[60] Provisional application No. 60/039,466, Feb. 27, 1997.

[51] Int. Cl.[7] ..... C10M 135/18

[52] U.S. Cl. ..... 508/363; 508/382; 508/485; 508/591

[58] Field of Search ..... 508/363

[56] References Cited

U.S. PATENT DOCUMENTS

| | | | |
|---|---|---|---|
| 2,220,843 | 11/1940 | Johnson | 252/37 |
| 3,970,570 | 7/1976 | Pratt et al. | 252/49.9 |
| 4,555,352 | 11/1985 | Garner et al. | 252/35 |
| 4,822,507 | 4/1989 | Kanamori et al. | 252/49.5 |
| 4,844,825 | 7/1989 | Sloan | 252/40.7 |
| 4,857,073 | 8/1989 | Vataru et al. | 44/57 |
| 5,254,652 | 10/1993 | Reimann et al. | 526/331 |
| 5,308,521 | 5/1994 | Pavilon et al. | 252/49.6 |
| 5,385,683 | 1/1995 | Ransom | 252/35 |
| 5,576,273 | 11/1996 | Karol et al. | 508/364 |
| 5,736,493 | 4/1998 | Garmier | 508/491 |
| 5,763,370 | 6/1998 | Doner et al. | 508/364 |

*Primary Examiner*—Ellen M. McAvoy
*Attorney, Agent, or Firm*—Sheldon H. Parker

[57] ABSTRACT

The invention relates to an extreme pressure lubricant composition, in per cent by weight, which includes from about 25 to about 37 percent polyalphaolefin, from about 1 to about 5 percent pentaerythritol ester of a fatty acid, from about 20 to about 35 percent of said methyl ester, from about 1 to about 10 percent of said copolymer of ethylene and propylene, from about 22 to about 32 percent of said bismuth salt and from about 1 to about 10 percent antimony diakyldithiocarbamate.

20 Claims, No Drawings

NON-HALOGENATED EXTREME PRESSURE, ANTIWEAR LUBRICANT ADDITIVE

CROSS-REFERENCE TO RELATED PATENT APPLICATIONS

This application relates back to Provisional Patent Application 60/039,466, filed Feb. 27, 1997, the subject matter of which is incorporated by reference as though recited in full.

FIELD OF THE INVENTION

This invention relates to the field of lubricants, and in particular to extreme pressure lubricants for motors, pumps and similar applications, and to lubricant additive systems for synthetic and natural oils.

BACKGROUND OF THE INVENTION

Special lubricant systems have been developed over the years to reduce friction and prevent wear and welding between working surfaces of bearings and gear teeth when, as a result of extreme pressure, low speed, high temperatures or reduced viscosity, the film which normally completely separates moving parts becomes thin enough to permit partial metal-to-metal contact. When moving machine parts are subjected to more severe conditions of load, speed and temperature, as for example, the high tooth pressures and high rubbing velocities often encountered in hypoid and spur type gearing, base lubricating oils themselves do not have the necessary qualities to provide adequate lubrication; metal to metal contact would occur which results in scoring, galling and local seizure of the gear teeth; therefore it is necessary to employ lubricants which contain extreme pressure additives.

Extreme pressure (EP) additives are a special class of boundary lubrication additives which chemically react with the metal surface to form compounds with a lower shear strength than the metal. The resultant low shear compound thus provides the requisite lubrication. EP oils are basically inhibited oils with added extreme pressure additives.

The combination of neodecanoic acid, one of the ingredients of EP additives, with diesel fuel is discussed in U.S. Pat. No. 4,857,073, which concerns Diesel fuel additives. More particularly, it relates to a novel additive composition which can be added to the fuel of an ordinary Diesel engine and is capable of increasing the efficiency of fuel combustion within the engine, thereby boosting engine power, improving fuel economy, and reducing objectionable tailpipe emissions, especially particulates and smoke. With the '073 invention, the efficiency of combustion within an internal combustion Diesel engine is improved, and increased fuel economy of a Diesel powered vehicle is realized, by incorporating into the Diesel fuel a minor amount of a particular additive composition comprising the following components: ditertiary butyl peroxide, tall oil fatty imidazoline, neodecanoic acid, and a hydrocarbon solvent carrier about 0.5 weight percent neodecanoic acid; the particular 2/1 relative amounts of tall oil fatty imidazoline to neodecanoic acid is important to achieving Diesel fuel stability and shelf life, and detergency which assists the ditertiary butyl peroxide in its effects on exhaust particulate reduction, and exhaust and smoke reduction. The acid acts as an initiator and stabilizer for the above peroxide, and helps provide resistance to microbial attack in diesel fuel.

SUMMARY OF THE INVENTION

The objects of the invention can be obtained through the use of extreme pressure lubricant composition which includes a polyalphaolefin, a pentaerythritol ester of a fatty acid acid, a methyl ester, a copolymer of ethylene and propylene, a bismuth salt of neodecanoic acid, and an antimony or a zinc salts, or a mixtures thereof.

The composition, in percent by weight, includes from about 25 to about 37 percent polyalphaolefin, from about 1 to about 5 percent pentaerythritol ester of a fatty acid acid, from about 20 to about 35 percent of said methyl ester, from about 1 to about 10 percent of said copolymer of ethylene and propylene, from about 22 to about 32 percent of said bismuth salt and from about 1 to about 10 percent antimony diakyldithiocarbamate.

Preferably the composition, ranges is from about 30 to about 35 percent polyalphaolefin, from about 2 to about 4 percent of said pentaerythritol ester, from about 23 to about 32 percent of said methyl ester, from about 2 to about 6 percent of said copolymer of ethylene and propylene in solvent extracted mineral oil, from about 24 to about 30 percent of said bismuth salt and from about 3 to about 7 percent antimony diakyldithiocarbamate.

The extreme pressure lubricant composition is most preferably, about 33 percent polyalphaolefin, about 3 percent of said pentaerythritol ester, about 28 percent of said methyl ester, about 4 percent of said copolymer of ethylene and propylene in solvent extracted mineral oil, about 27 percent of said bismuth salt and about 5 percent antimony diakyldithiocarbamate.

The specific, preferred composition is 32.6 percent hydrogenated 1-decene homopolymer, 3.1 percent pentaerythritol esters of C % to C10 fatty acids, 0.4 percent of an anti-wear hydraulic oil additive sold under the designation LZ 5178F, 28 percent methyl ester, 4 percent of a lube oil additive containing a copolymer of ethylene and propylene in solvent extracted mineral oil, and sold under the designation ECA 4983 (PARATONE 8259), 27 percent of the bismuth salt and 5 percent antimony diakyldithiocarbamate. The CAS number for the polyalpha olefin is 68037-01-4, and the product designation is DURSYN 166. The CAS number for the pentaerythritol ester is 68424-31-7 and the product designation is EM 2939. The CAS numbers for the bismuth salts are 34364-26-6 and 26896-20-8, and it is sold under the designation Catalyst 310. The antimony thiocarbamate is sold under the designation VANLUBE 73. The zinc salt is sold under the designation VANLUBE AZ.

Synonyms for the bismuth sale are bismuth trineodecanoate, COSCAT 83 and neodeconic acid bismuth salt. Synonyms for the neodecanoic acid are TOPPER 5E and WILTZ 65. The formula is $C_{10}H_{20}O_2$.

The methyl ester, is designated Base ML and its CAS number identifies it as a 1-decene hydrogenated homopolymer.

The antimony and zinc carbamates have CAS numbers, respectively, 64742-52-5 and 15337-18-5.

DETAILED DESCRIPTION OF THE INVENTION EMBODIMENTS

The instant invention is a halogen-free, extreme pressure, friction reducing, antiwear lubricant additive. The current embodiments of the instant invention contain no solids, chlorinated paraffins, or heavy metal resins. The lubricant blends fully and does not separate, and has non-corrosive and anti-corrosive properties. It is designed to be usable in car engines, including diesel engines, worm and planetary gearboxes, both manual and automatic transmissions, as well as bearings and shafts. In the area of machining the lubricant can be used for cutting, drilling, and extruding; in reciprocal and rotary vein compressors, and centrifugal and reciprocating pumps.

In the production of prior art lubricants numerous substances, for example, oleic acid, tricresyl phosphate, sulfur bearing compounds, sperm oil and sulfurized sperm oil, may be added to the base lubricant to contribute various properties or characteristics to the finished lubricant. The terms extreme pressure, film strength properties, oiliness and lubricity all refer to the ability of lubricants to reduce friction, as well as prevent wear and welding between working surfaces of bearings and gear teeth. This friction occurs as a result of extreme pressure, low speed, high temperatures or reduced viscosity, causing the film which normally completely separates moving parts to become thin enough to permit metal-to-metal contact. Conventionally employed additives are generally phosphorus, chlorine and/or sulfur compounds which react with metal surfaces to reduce friction and prevent welding.

Numerous lubricant compositions which contain antiwear agents and/or extreme pressure additives are known, and have been described in various patents and other literature. For instance, Johnson describes in U.S. Pat. No. 2,220,843 an extreme pressure lubricant which comprises a major proportion of a refined lubricating oil and as additives, a sulfurized ester of an unsaturated acid and a heavy metal naphthenate.

While many elements and compounds are mentioned in the prior art, there is no reference as to which combinations are most effective. Each prior patent discloses a discrete set of combinations that tend to have all of the component elements known in the prior art. Patentability, however, is obtained through the components being used for a different purpose or in a different combination. Thus, the mere mention of a chemical in the prior art does not make it known for the current use or for the current combination.

The disclosed non-halogenated extreme pressure, friction reducing, antiwear additive forms a bond that modifies surfaces to provide constant protection. The non-halogenated formula reduces waste disposal problems, is safer for handling, and imparts long lasting protection. The disclosed antiwear additive improves fuel economy, increases horsepower and torque, and prevents damage from total loss of lubricant. The lubricant further eliminates excessive wear from dry starts, protects equipment from contamination, reduces heat due to friction, and decreases additional wear from alcohol fuels. These benefits result in lower maintenance costs, extended equipment life cycle, and reduced environmentally harmful emissions.

Lubricating compositions reduce friction and reduce, or prevent, destructive contact between moving metal surfaces as long as a lubricating film is maintained between the moving surfaces. This particular type of lubrication is referred to as hydrodynamic lubrication. Some antiwear additives enhance the hydrodynamic lubrication of motor oils and the like. However, when the pressure and/or rubbing speeds between the moving metal surfaces increase, the lubricating film is forced out from between the moving metal surface. This results in metal-to-metal contact and wear.

Lubrication under extreme pressure conditions requires an additive that is adsorbed by or reacts with the metal to form an adherent protective film having a lower shear strength that the metal. This type of lubrication is called boundary lubrication, and additives enhancing this type of lubrication are known as extreme pressure, antiwear additives (EP additives). EP lubricants are basically inhibited oils with added extreme pressure additives. Synthetic lubricants, which are used as a base, provide superior boundary lubrication.

The EP additives reduce friction temperatures and allow the lubricant to remain in and on the metal surfaces. The resultant low shear compound thus provides the requisite lubrication. EP oils are basically inhibited oils with added extreme pressure additives. The EP agent serves to control wear in the boundary lubrication phase; namely, starting stopping, shock loading and the like. If high points of mating surfaces come in contact during machine operation, the lower shear strength EP compound will shear, rather than fuse and cause scoring; thus, controlled wear is exchanged for destructive wear. EP additives find utility in greases, industrial oils and gear lubes.

The disclosed non-halogenated antiwear additive uses a synthetic or petroleum based antiwear hydraulic oil as a base for the composition, which is mixed with other components to enhance desired properties. It also utilizes different extreme pressure additives to increase its lubricating effectiveness and antiwear agents to reduce scuffing. The invention contains extreme pressure antiweld agents which react rapidly with metal to prevent galling.

There is no teaching in the prior art to the combination used in the instant invention or in its ability to get dramatically superior results. However, there is some teaching on the properties of individual components.

Bismuth Neodecanoate (Bismuth Salt of Neodecanoic Acid).

Neodecanoic acid is outstanding at improving flow properties and can be found on the market under the names VERSATIC acid 9 and VERSATIC acid 10. They are tertiary carboxylic acids which are prepared by Koch synthesis, i.e. reaction of olefins with carbon monoxide and water.

Base oils can be improved to an extent by the addition of a synergistic mixture of metal organic compounds and compounds free from heavy metal and containing sulfur and phosphorus. Bismuth is one of the metal-organic compounds that can be used to accomplish the synergy.

A compound composed of Bismuth salt of neodecanoic acid is added to the instant invention. It is a straw colored liquid with a typical flash point of 230 F. By weight it is 75% Bismuth neodecanoate and 25% Neodecanoic acid. It is also possible to use Bismuth Octoate or Bismuth Naphthenate. Some of the compound's properties are as follows:

| CHARACTERISTICS | LIMITS | METHODS | TYPICAL |
|---|---|---|---|
| % Bismuth | 19.5–20.5 | MCI 64–69 | 20.0 |
| Color, Gardner | 11 Max. | ASTM D 1544 | 9 |
| Viscosity, Gardner | Z-6 Max. | ASTM D 1545 | Z |
| % NVM | 80–90 | ASTM D 1644 B | 85 |
| Specific Gravity | 1.10–1.20 | ASTM D 1963 | 1.178 |
| Weight/Gallon, Lbs. | 9.20–10.0 | ASTM D 1963 | 9.75 |

Bismuth is often used in lubricants/compounds as a flame retardant. However, in the instant invention it is being used as a lubricant.

Neodecanoic acid's properties are discussed in U.S. Pat. No. 5,254,652. Its teaching relates to terpolymers which, in addition to ethylene units, contain 5% to 35% by weight of vinyl acetate units, and 1% to 25% by weight of vinyl neononanoate or vinyl neodecanonate units and have a number average molecular mass (M/n) of 500 to 5,000 g/mol. It further relates to the use of the terpolymers described above for improving the flow properties of mineral oils and, in particular, mineral oil distillates.

Surprisingly, the terpolymers have proven to be outstandingly suitable for improving the flow properties of those mineral oils and mineral oil distillates for which it has not been possible to influence the flow properties with the additives of the prior art. Mixtures of the monomers are used as the starting substances for the preparation of the inventive terpolymers comprising ethylene, vinyl acetate, and vinyl neononanoate or vinyl neodecanoate. The vinyl esters of neononanoic acid and neodecanoic acid are commercial products which are obtained, for example, by reaction of the acids on which they are based with acetylene.

Olefin Copolymer Viscosity Improved

The use of the olefin copolymer compound provides good shear stability and serves as a viscosity modifier, which is sometimes referred to as a viscosity index improver. This material has the function of controlling the rate, or amount, of viscosity change of a lubricant as a function of temperature. The material tends to have comparatively little thickening effect at low temperatures but significant thickening at high temperatures. This behavior extends the temperature range over which a lubricant can be used. Some properties of olefin copolymer are discussed in U.S. Pat. No. 5,308,521.

Another embodiment can include acryloid 3033 which enables blending with a wider range of oils. This acryloid is one of the acryloid 3000 series of pour point reducers that is produced by RohMax. ACRYLOID 3033 is a alkyl methacrylate polymer which is diluted in a high quality base oil. As stated therefore, these additives improve the flow of oil under low temperature conditions by reducing the formation and growth of paraffinic wax crystals and preventing the formation of an interlocking network which would prevent oil flow.

In formulating lubricant and hydraulic fluid compositions containing the antiwear additive mixture of the disclosed invention, the tricresyl phosphate can be usefully employed in a concentration of from about 0.5 to 3%, and more preferably from 1 to 2% by weight of the total composition. The pentaerythritol monooleate may be employed at a concentration of from about 0.25 to 2%, and more preferably from 0.5 to 1%. Higher concentrations of tricresyl phosphate do not appreciably enhance the antiwear properties of the formulation. Higher concentrations of pentaerythritol monooleate are less desirable in most lubricant formulations in as much as this material is a good water and oil emulsifier and will increase the tendency of the lubricant to pick up and retain moisture. The exact ratio of the tricresyl phosphate to pentaerythritol monooleate is not critical, best results are obtained having the tricresyl phosphate present in an amount of from one to four times the amount of the monooleate. For optimum results, however, the total concentration of the additive mixture should be at least 2% by weight of the total formulation; that is, the concentration of the tricresyl phosphate plus the concentration of the pentaerythritol monooleate should add up to or exceed 2%.

METHODS OF TESTING

Extreme Pressure Testing Method

The effectiveness of an extreme pressure lubricant can be readily demonstrated using an extreme pressure testing machine. The use of such a machine is explained in U.S. Pat. No. 4,844,825, which is incorporated herein as though recited in full. This machine utilizes an electric motor to rotate a steel bearing race. A stationary steel bearing is brought into contact with the rotating bearing race. This is done by removably inserting the bearing into the end of a rotating arm which is allowed to rest in contact with the rotating bearing. The arm is, in turn, levered by a second rotating bearing and is equipped to allow for weights to be applied to the end of the arm. The effect of the arrangement of the arms is to provide weight at the end of the latter arm, the weight being magnified, through the principle of the lever, through to the point of contact with the rotating bearing race. Because of the small area of contact, substantial pressure is applied by the stationary bearing to the rotating bearing race.

TEST I

The bearing race is initially allowed to rotate in a bath of a standard motor oil, and the end of the arm with the test bearing is allowed to rest on the rotating race without additional pressure. On examination of the test bearing, it is found that a small scar, approximately one millimeter in width is formed in the surface of the bearing due to the friction.

TEST II

The test bearing is then rotated to apply a fresh surface to the bearing race, and again the test bearing is allowed to contact the rotating race. A weight of approximately four pounds is applied to the end of the multiple lever apparatus to apply more pressure to the point of contact. Upon examination of the test bearing, a large scar has been formed in the surface of the bearing, approximately four millimeters in width.

TEST III

The procedure in test I is then repeated, adding an amount of the disclosed EP lubricant to the motor oil bath in which the bearing race is rotating. Again, the test bearing is rotated to present a fresh surface to the bearing race and is allowed to rest in contact against the rotating race without additional pressure. Upon examination of the test bearing, it is found that the initial amount of scarring has been greatly reduced.

TEST IV

Test III is repeated using a four pound (1.81 kg.) weight at the end of the lever mechanism. The scarring is still less than what was present in the oil only tests without additional pressure, with the scar now being less than one millimeter in width. Rather than being a deep gouge out of the surface of the bearing, as was the case with the oil only bath, the point where the test bearing contacted the bearing race rotating in the oil with lubricant additive appears to the eye to be a small polished area on the surface of the bearing.

TEST V

Test III is repeated with the weight at the end of the lever mechanism increased by a factor of six from the four pound (1.81 kg.) weight. The size of the scar on the test bearing does not increase significantly and still is not significantly greater in width then was the case with the oil only bath without additional pressure. Indeed, the surface of the scar is shown to be polished compared to the pitted scar present in the oil only bath.

The antiwear properties of different blends can be compared using the Falex Lubricant Tester known to workers in the field of lubrication, and described in U.S. Pat. No. 3,970,570, which is incorporated herein as though recited in full.

Shell 4-Ball EP Lubricant Testing Methods

In the Shell 4 Ball apparatus, used to show friction reduction, three steel balls, covered by the lubricant to be tested, are held tightly in a circular holder, and a fourth ball, held in a movable chuck, is lowered until it contacts the other three. A load is applied to the fourth ball by means of a lever arm to which the appropriate weights are attached. The fourth ball is then rotated against the other three at a speed of 1750 rpm for the desired period of time. If the lubricant fails completely, the four balls will be welded together; otherwise, circular scars will be left on each ball at the point of contact, the diameter of which will be proportional to the amount of wear that has occurred.

TEST VI

In the evaluation of the antiwear additive mixture of an invention, the Shell 4 ball apparatus was run for one hour with a load of 40 kilograms.

Falex Lubricant Tester

In the Falex apparatus, pressure is applied on opposite sides of a rotating steel pin by two V shaped blocks held by two movable arms and immersed in a container of the lubricant or grease to be tested. The pin and blocks are weighed before and after the test, and the amount of weight loss is a measure of the amount of wear that has occurred.

TEST VII

In the Falex tests a pressure of 600 psig was applied on the pin for a period of one hour. The pin immersed in a prior art lubricant resulted in a 25% material weight loss.

TEST VIII

Test VII was repeated, immersing the pin in the disclosed lubricant. After one hour, there was a 2% material weight loss, as illustrated by the following table.

The ASTM D-3233 Falex Pin & "V" Block Test was performed on the instant invention and showed dramatically good properties of the instant invention.

| | Starting Torque | Final Torque | Smoke |
|---|---|---|---|
| 300 lbs @ 5 min | 9½ lb-in | 8 lb-in | NO |
| 500 lbs @ 1 min | 12 lb-in | 12 lb-in | NO |
| 750 lbs @ 1 min | 17½ lb-in | 28 lb-in | NO |
| 1000 lbs @ 1 min | 28 lb-in | 34 lb-in | NO |
| 1250 lbs @ 1 min | 30 lb-in | 34 lb-in | NO |
| 1500 lbs @ 1 min | 44 lb-in | 41½ lb-in | NO |
| 1750 lbs @ 1 min | 46 lb-in | 45 lb-in | YES |
| 2000 lbs @ 1 min | 49½ lb-in | 47 lb-in | YES |
| 2250 lbs @ 1 min | 52 lb-in | 49 lb-in | YES |
| 2500 lbs @ 1 min | 54 lb-in | 51½ lb-in | YES |
| 2750 lbs @ 1 min | 58 lb-in | 57 lb-in | YES |
| 3000 lbs @ 1 min | 65 lb-in | 64 lb-in | YES |
| 3250 lbs @ 1 min | 72 lb-in | 72 lb-in | YES |
| 3500 lbs @ 1 min | 78 lb-in | 76 lb-in | YES |
| 3750 lbs @ 1 min | 82 lb-in | 85 lb-in | YES |
| 4000 lbs @ 1 min | 91 lb-in | 94 lb-in | YES |
| 4250 lbs @ 1 min | 96 lb-in | 97 lb-in | YES |
| 4500 lbs @ 1 min | 100 lb-in | 104 lb-in | Load, Lbs. |

Test Samples: #1 — Formula Shell 10W 30
#2 — Formula Shell w/ DynaShield 9000 blended @ 5.88% (2 oz./Qt.)

Testing was performed simulating ASTM D 2714 (Modified) Falex Block-on-Ring Friction and Wear Test. One modification employed was the use of a cylinder in lieu of a Falex block, creating cross cylinder geometry. Another modification employed for the test, was the exertion of higher pressure. A load of 4,500 lb. is exerted by a 45 lb. dead load at a ratio of 100:1. The last modification used was stepping the load up incrementally. The load was stepped up 5 lbs. every 10 seconds until a maximum load of 45 lbs. was attained. The load was then maintained for 3½ minutes. The total duration for the test was 5 minutes. The friction can be inferred from the number of amps the motor draws in order to maintain rotation of the race.

| SAMPLE | WEAR SCAR | PEAK AMPS | MAXIMUM OIL TEMP. | ENDING OIL TEMP. |
|---|---|---|---|---|
| Formula Shell 10W30 | 8.25 mm | 8 | 215.8° F. | 205.6° F. |
| DYNASHIELD Blend | 5.00 mm | 5 | 176.4½ F. | 176.4½ F. |

This test revealed that the DYNASHIELD 9000 blended with the primary oil provided the following results.

| | |
|---|---|
| Wear Reduction: | 3.25 mm (40.6%) |
| Coefficient of Friction Reduction: | 3 Amps (37.5%) |
| Temperature Reduction: | Peak: 39.4½ F. Ending: 29.2 |

Testing was repeated modifying the procedure stepping up the load 5 lbs. every 20 seconds until lubrication failure is achieved.

| SAMPLE | WEAR SCAR | PEAK AMPS | MAXIMUM OIL TEMP. | ENDING OIL TEMP. | Seizure Load |
|---|---|---|---|---|---|
| Formula Shell 10W30 | 9.25 mm | 10 | No record | No record | 6,500 lb. |
| DYNA-SHIELD Blend | 3.00 mm | 5 | No record | No record | See note[1] |

This test revealed that the DYNASHIELD 9000 blended with the primary oil provided the following results.

| | |
|---|---|
| Wear Reduction: | 6.25 mm (67.56%) |
| Temperature Reduction: | Not recorded |
| Coefficient of Friction Reduction: | 5 Amps (50%) |
| Load Carrying Improvement: | 9,500 lb. (146%) |

Test Samples: #1 — Formula Shell 10W 30
#2 — Formula Shell w/ DYNASHIELD 9000 blended @ 5.88% (2 oz./Qt.) 2

Testing was performed simulating ASTM D 2714 (Modified) Falex Block-on-Ring Friction and Wear Test. The following modifications were imposed:

1. A hardened steel cylinder replaced the Falex test block, creating cross cylinder geometry.
2. Final load was increased to 4,5000 lb., exerted by a 45 ft-lb. dead load at a ratio of 100:1.
3. Load was applied incrementally. Load was stepped up 5 ft-lb. every 10 seconds until a maximum load of 45 ft-lb. was attained. The load was then maintained for 3½ minutes for a total test duration of 5 minutes.

Current draw indicated on the direct reading ammeter provides a straight-line relationship to the friction experienced at the point of contact between the metal surfaces. An increased current draw by the motor in order maintain rotation of the ring reflects an increase of friction (decrease of lubrication).

CHEMICAL PROPERTIES

The disclosed additive includes antimony, in an oil solution, and indium ingredients. The indium can be used instead of, or in addition to, the bismuth.

In the above embodiments of the instant invention there has been an avoidance of the use of chlorinated paraffins. U.S. Pat. No. 4,844,825 describes some of the properties chlorinated paraffins, and is incorporated herein as though cited in full. It is known that certain chlorine based compounds, such as those chlorine derivatives of paraffinic hydrocarbon compounds referred to as chlorinated paraffins, can serve as lubricant additives to improve the performance of the lubricant under extreme pressure. Where an extreme pressure additive such as chlorinated paraffin is present, however, it has been found that the resultant heat generated between the two surfaces causes chlorine atoms to be liberated from the additive and to combine with the surface metal, such as iron, to form a chloride, such as iron chloride. This surface coating of chloride has a much lower coefficient of friction than the dry metal surface and tends to fill in depressions in the surfaces, resulting in smoother surfaces at the point of interaction and reduced friction and wear.

Chlorinated paraffins have been used as extreme pressure additives in such applications as metal working. However, the corrosive nature of chlorinated paraffins have made them generally unsuitable for use in internal combustion engine applications or other corrosion sensitive applications. Under heating, the chlorinated paraffins release hydrochloric acid, which is corrosive.

Some properties of naphthenic oil are discussed in U.S. Pat. No. 4,822,507 which teaches the use of naphthenic oil in a lubricating oil composition. At least one oil selected from the group consisting of a mineral oil and a synthetic oil is used in '507. This component is a base material of the lubricating oil composition. There are no special limitations to these mineral and synthetic oils. It is, however, preferred to use a mineral oil and/or a synthetic oil having a viscosity of 5 to 55 centistokes (cst) as determined at 40 C. Typical examples of the mineral oil are a lubricating oil fraction of naphthenic, intermediate and paraffinic mineral oils, and a high aromatic component as obtained by decomposition of such mineral oils.

A discussion of antiwear agents and/or extreme pressure additives used in other patents and literature is provided in U.S. Pat. No. 4,555,352. For instance, Johnson describes in U.S. Pat. No. 2,220,843 an extreme pressure lubricant which comprises a major proportion of a refined lubricating oil and as additives, a sulfurized ester of an unsaturated acid and a heavy metal naphthenate. '352 also mentions U.S. Pat. No. 2,276,341 (Prutton) where an extreme pressure lubricant is described, which comprises a hydrocarbon lubricating oil, from about 1% to about 5% of a metal naphthenate or naphthenic acid ester, and any one of a wide variety of halogenated organic compounds. '352 also refers to naphthenic 5% to 40% by weight of diesel oil, or of a hydrocarbon oil having physical characteristics comparable to said diesel oil; said composition functioning both as a friction reducing agent and as an extreme pressure (EP) additive. This heavy duty formulation may also (desirably) include 0.10% to 5.00% by weight of an oil soluble zirconium containing soap selected from the group consisting of zirconium naphthenate, zirconium 2 ethylehexanoate, zirconium, 3,5 dimethyl hexanoate, and zirconium neodecanoate, or mixtures thereof.

Additives which may give good low temperature properties are discussed in U.S. Pat. No. 4,990,273. These include substantially all oleaginous materials such as lubricating oils or greases derived from mineral or synthetic oil or mixtures thereof. Lubricating oils may be of the naphthenic or paraffinic types, with mineral and synthetic oil of any suitable lubricating viscosity useful for the purposes of the present invention. In the case of greases, substantially any grease, e.g., metal soap grease, is improved in respect to its antiwear properties and extreme pressure characteristics by the use of the additive of the invention. The preferred oleaginous materials are lubricating oils for use in gasoline powered internal combustion engines, i.e., motor oils.

What is claimed is:

1. An extreme pressure lubricant composition consisting essentially of:

a) a polyalphaolefin, b) a pentaerythritol ester of a fatty acid acid, c) a methyl ester d) a copolymer of ethylene and propylene, e) a bismuth salt of neodecanoic acid, and f) of a member selected from antimony and zinc salts, and mixtures thereof.

2. An extreme pressure lubricant composition said composition, in per cent by weight, comprising from about 25 to about 37 percent polyalphaolefin, from about 1 to about 5 percent pentaerythritol ester of a fatty acid acid, from about 20 to about 35 percent of said methyl ester, from about 1 to about 10 percent of said copolymer of ethylene and propylene, from about 22 to about 32 percent of said bismuth salt and from about 1 to about 10 percent antimony diakyldithiocarbamate.

3. The extreme pressure lubricant composition of claim 1, wherein said composition, in per cent by weight, comprises from about 30 to about 35 percent polyalphaolefin, from about 2 to about 4 percent of said pentaerythritol ester, from about 23 to about 32 percent of said methyl ester, from about 2 to about 6 percent of said copolymer of ethylene and propylene in solvent extracted mineral oil, from about 24 to about 30 percent of said bismuth salt and from about 3 to about 7 percent antimony diakyldithiocarbamate.

4. The extreme pressure lubricant composition of claim 1, wherein said composition, in per cent by weight, comprises from about 33 percent polyalphaolefin, from about 3 percent of said pentaerythritol ester, from about 28 percent of said methyl ester, from about 4 percent of said copolymer of ethylene and propylene in solvent extracted mineral oil, from about 27 percent of said bismuth salt and from about 5 percent antimony diakyldithiocarbamate.

5. The extreme pressure lubricant composition of claim 2, wherein said polyalphaolefin is a hydrogenated 1-decene homopolymer, said pentaerythritol ester, is an ester of a C5 to a C10 fatty acid, and said bismuth salt is a bismuth neodecanoate.

6. The extreme pressure lubricant composition of claim 1, wherein said salt is a thiocarbamate.

7. The extreme pressure lubricant composition of claim 6, wherein said salt is antimony dialkyldithiocarbamate.

8. The extreme pressure lubricant composition of claim 7, wherein said salt is antimony dipentylithiocarbamate.

9. The extreme pressure lubricant composition of claim 6, wherein said salt is zinc dialkyldithiocarbamate.

10. The extreme pressure lubricant composition of claim 7, wherein said salt is zinc dipentylithiocarbamate.

11. The method of protecting metal wear surfaces against extreme pressure conditions, comprising the step of applying a lubricant composition to said surfaces, said lubricant composition consisting essentially of:

a) a polyalphaolefin, b) a pentaerythritol ester of a fatty acid acid, c) a methyl ester d) a copolymer of ethylene and propylene, e) a bismuth salt of neodecanoic acid, and f) of a member selected from antimony and zinc salts.

12. The method of claim 11, wherein said composition, in per cent by weight, comprises from about 25 to about 37 percent polyalphaolefin, from about 1 to about 5 percent pentaerythritol ester of a fatty acid acid, from about 20 to about 35 percent of said methyl ester, from about 1 to about 10 percent of said copolymer of ethylene and propylene, from about 22 to about 32 percent of said bismuth salt and from about 1 to about 10 percent antimony diakyldithiocarbamate.

13. The method of claim 11, wherein said composition, in per cent by weight, comprises from about 30 to about 35 percent polyalphaolefin, from about 2 to about 4 percent of said pentaerythritol ester, from about 23 to about 32 percent of said methyl ester, from about 2 to about 6 percent of said copolymer of ethylene and propylene in solvent extracted mineral oil, from about 24 to about 30 percent of said bismuth salt and from about 3 to about 7 percent antimony diakyldithiocarbamate.

14. The method of claim 11, wherein said composition, in per cent by weight, comprises about 33 percent polyalphaolefin, about 3 percent of said pentaerythritol ester, about 28 percent of said methyl ester, about 4 percent of said copolymer of ethylene and propylene in solvent extracted mineral oil, about 27 percent of said bismuth salt and from about 5 percent antimony diakyldithiocarbamate.

15. The method of claim 12, wherein said pentaerythritol ester, is an ester of a C5 to a C10 fatty acid, and said bismuth salt is a bismuth neodecanoate.

16. The method of claim 11, wherein wherein said salt is a thiocarbamate.

17. The method of claim 16, wherein wherein said salt is antimony dialkyldithiocarbamate.

18. The method of claim 16, wherein wherein said salt is antimony dipentylithiocarbamate.

19. The method of claim 16, wherein said salt is zinc dialkyldithiocarbamate.

20. The method of claim 16, wherein said salt is zinc dipentylithiocarbamate.

* * * * *